United States Patent [19]

Hochart

[11] Patent Number: 4,744,510

[45] Date of Patent: May 17, 1988

[54] ASSEMBLY FOR PACKAGING OBJECTS

[75] Inventor: Jean Hochart, Soissons, France

[73] Assignee: Cartonneries de Saint-Germain, France

[21] Appl. No.: 921,959

[22] Filed: Oct. 20, 1986

[30] Foreign Application Priority Data

Feb. 24, 1986 [FR] France ..... 86 02480

[51] Int. Cl.[4] ..... B65D 3/28

[52] U.S. Cl. ..... 229/125.19; 229/5.5; 229/23 BT; 229/902; 229/DIG. 14; 426/130; 493/104; 493/108; 493/128; 493/152

[58] Field of Search ..... 229/23 R, 23 BT, 8, 229/43, 4.5, 5.5, 125.19, 902, DIG. 14; 426/129, 130; 493/104–109, 128, 131, 152, 183, 379, 383

[56] References Cited

U.S. PATENT DOCUMENTS

| | | | |
|---|---|---|---|
| 63,267 | 3/1867 | Lewis | 229/4.5 |
| 315,896 | 4/1885 | Brenton | 229/4.5 |
| 676,747 | 6/1901 | Grim | 229/5.5 |
| 1,020,187 | 3/1912 | Claussen | 229/5.5 |
| 1,209,040 | 12/1916 | Rudnick | 229/4.5 |
| 1,568,608 | 1/1926 | Klein | 229/8 |
| 1,733,674 | 10/1929 | Schleicher | 229/4.5 |
| 1,772,878 | 8/1930 | Schleicher | 229/8 |
| 2,149,625 | 3/1939 | Pabst | 229/23 R |
| 2,238,256 | 4/1941 | Engel et al. | 229/8 |
| 2,389,547 | 11/1945 | Ringler | 229/43 |
| 2,755,983 | 7/1956 | Ringler | 229/4.5 |

FOREIGN PATENT DOCUMENTS

| | | | |
|---|---|---|---|
| 1119506 | 6/1956 | France | 426/130 |
| 1077071 | 7/1967 | United Kingdom | 220/405 |
| 1246413 | 9/1971 | United Kingdom | 229/8 |

*Primary Examiner*—Stephen Marcus
*Assistant Examiner*—Gary E. Elkins
*Attorney, Agent, or Firm*—Darby & Darby

[57] ABSTRACT

Disclosed is a box assembly for packaging objects, the box including a lower portion and an upper portion, one portion slidably fitting onto the other portion. The box includes a flat lower wall section; a flat upper wall section, having a different surface area from the lower wall section; and a pair of elongated side wall sections. The side wall sections include a plurality of spaced apart tabs extending from one longitudinal edge of each section. The tabs can be folded at substantially right angles to the elongated side wall section. The tabs of one side wall section can be adhered to the perimeter surface of the lower wall section, and the tabs of the other side wall section can be adhered to the perimeter surface of the upper wall section. When the elongated side wall sections are adhered to the lower and upper wall sections, respectively, the lower and upper portions of the box are formed. A method of packaging objects with the box assembly is also disclosed.

10 Claims, 1 Drawing Sheet

ASSEMBLY FOR PACKAGING OBJECTS

FIELD OF THE INVENTION

The present invention relates to a packaging box for objects of various rounded shapes and a method for packaging such objects.

BACKGROUND OF THE INVENTION

For packaging objects of a rounded form, such as wheels of cheese, boxes, made from one of many materials including wood, crimped or embossed cardboard are used. A top and a bottom piece, each one stapled or glued on a strip constituting a generally cylindrical form, together form the top and bottom respectively, of the box. The two cylindrical surfaces slide into one another to form a closed box. The advantages of such a box are as follows. First, the box is rigid, and stacking of boxes is facilitated. Second, the boxes have an esthetic aspect corresponding to an image of quality. Finally, stapled boxes are serrated at the juncture of the top and bottom pieces and the strip due to the staples which allows air to flow over practically the entire perimeter of the top and bottom. However, these boxes also have serious drawbacks. First of all, the boxes are made by special machines which are typically remote from the location where the boxes are to be used in packaging. The boxes are therefore assembled, stored, and shipped to the point of use, again stored and finally opened before being filled and reclosed. If the boxes are to receive a distinctive marking (such as a brand name), the mark can be applied in a number of ways. The mark can be applied by burning on the top if the boxes are made of wood, or by gluing a pre-printed label if the boxes are made of wood or cardboard. Labeling multiplies the number of operations involved in the production of the boxes. Finally, in view of the foregoing, the production of these types of boxes is expensive.

OBJECTS OF THE INVENTION

One object of the present invention is to provide a packaging box, for cheeses, for example, which is easy to put to use entirely by automatic means. The box has the advantages of the former type of box described above without the drawbacks. In other words, it will be esthetic, sufficiently rigid and serrated, but inexpensive. The box can be marked beforehand, and assembled at the last moment at the point of use. This will eliminate the drawbacks of the crimped or embossed cardboard box which include lack of rigidity, and dislocation of the components during assemblies.

SUMMARY OF THE INVENTION

These and other objects of the present invention are met by providing a box assembly for packaging objects, the box including a lower portion and an upper portion, one portion slidably fitting onto the other portion. The box includes a flat lower wall section; a flat upper wall section, having a different surface area from the lower wall section; and a pair of elongated side wall sections. The side wall sections include a plurality of spaced apart tabs extending from one longitudinal edge of each section. The tabs can be folded at substantially right angles to the elongated side wall section. The tabs of one side wall section can be adhered to the perimeter surface of the lower wall section, and the tabs of the other side wall section can be adhered to the perimeter surface of the upper wall section. When the elongated side wall sections are adhered to the lower and upper wall sections, respectively, the lower and upper portions of the box are formed.

BRIEF DESCRIPTION OF THE DRAWNGS

Other characteristics will appear from the description which follows with reference to the attached drawing in which.

DETAILED DESCRIPTION OF THE PREFERRED EMBODIMENTS

Figure 1:
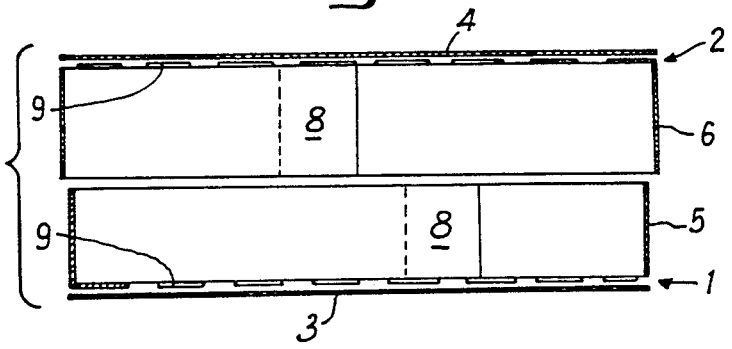
FIG. 1, shows a view in axial section of an open box according to one embodiment of the invention.

Referring to FIG. 1, there is shown a packaging box according to the invention. A bottom 1 and a lid 2, are formed form cutouts 3 and 4, respectively, and bands 5 and 6, respectively. Cutouts 3 and 4 form the bottom and top parts, respectively, of the box. The bands constitute lateral surfaces that are cylindrical, oval, oblong, or any other rounded form, such that one band has a slightly smaller perimeter than the other and can slide within the other to close the box.

Figure 2:
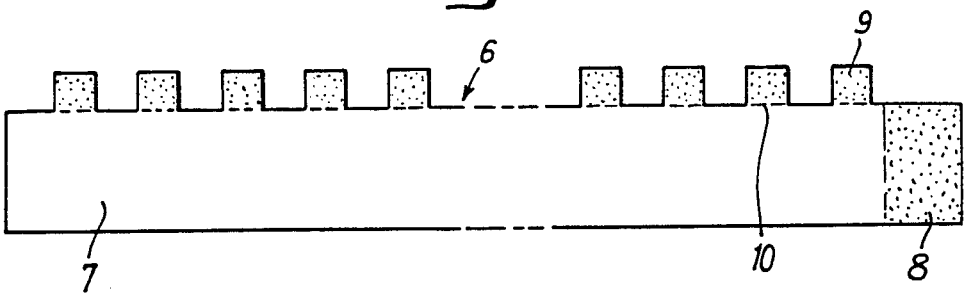
FIG. 2, shows a flattened view of a band constituting the lateral face of the lid of the box according to FIG. 1.

Cutouts 3, 4 and bands 5, 6 are preferably made of cardboard and are supplied flat. A band such as the one shown in FIG. 2 includes a rectangular strip 7 with a spur 8 at one end, and along one edge, a series of spaced apart tabs 9. Tabs 9 can be spaced regularly or irregularly. The base of each tab is marked by a scoring line 10, to make the tabs easy to fold along the edge of the band. Spur 8 and tabs 9 are preglued on one side.

To construct the lid 2 of the box 1, strip 7 is coiled to form a closed loop and spur 8 is glued to the opposite end of the strip. All the tabs 9 are folded to right angles with strip 7 towards the center of the loop. Cutout 4 constituting the top of the box is glued to the upper surface of folded tabs 9. The gluing is easily done since tabs 9 and spur 8 are coated with a thermosetting or thermosealing product. Other types of glue can be used.

In the embodiment described, the tabs 9 are glued under the top of the box, or on top of the bottom piece of the box. It is also possible to glue the tabs over the edge of the top or bottom piece of the box, such that the tabs are exposed in the finished box, without departing from the scope of the invention.

Since all the components of the box are made of cardboard, its advantages are clear. First of all, the components of the box can be stored flat, and require little storage space. The top 4 and lid band 6, being made of cardboard, can be pre-printed with a desired logo or mark on the obverse and/or reverse side. Moreover, lid 2, whose tabs 9 and spur 8 are coated with a thermosetting product or other type of glue, can be assembled just prior to packaging with simple means. Devices for distributing hot glue, which involve a delicate and dangerous operation, are therefore not needed. The same is true for the bottom 1.

Furthermore, when the lid is assembled there is a serration space between strip 7, top 4 and each tab 9. This is particularly suitable for the proper ventilation of the boxes and the proper preservation of certain packaged products such as cheeses.

Figure 3:
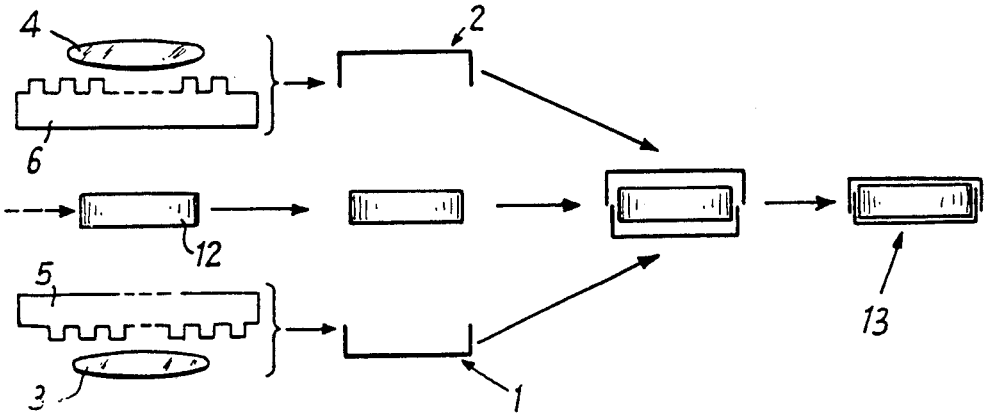
FIG. 3, shows a diagram of a packaging line involving application of the method according to the invention.

According to one embodiment of the invention, the lid and the bottom of the box are assembled only in the vicinity of the end of the production line of the product to be packaged. FIG. 3 symbolizes the various phases of the packaging process according to the invention. A cheese wheel, for example, perhaps packed in its paper wrapper, emerging from the production line, is symbolized as 12. In the vicinity of this end of the line, the top 4 and the band 6 are assembled by thermosetting to constitute the lid 2. At the same time the bottom piece 3 and band 5 are assembled by thermosetting to constitute the bottom 1. In the following stage, the bottom 1 and the lid 2 are put in place around the object to be packaged, resulting in the packaged object 13 at the end of the line.

It is clear that substantial savings are achieved in the storage and handling of the boxes. In particular, all the operations of the packaging process, from the feed of the components of the box to the delivery of the object packaged in the box, are automatic. It should be pointed out that the box according to the invention can just as well be round, as rounded, oblong, oval, square or even rectangular in form with rounded or sharp corners.

What is claimed is:

1. A box assembly for packaging objects, said box including a lower portion and an upper portion, one portion slidably fitting onto the other portion, comprising a flat lower wall section;

a flat upper wall section, having a different surface area from said lower wall section; and a pair of elongated side wall sections, the side wall sections including a plurality of spaced apart tabs extending from one longitudinal edge of each section, said tabs being folded at substantially right angles to said elongated side wall section and said tabs of one side wall section being adherable to an inside perimeter surface of said lower wall section, and said tabs of the other side wall section being adherable to an inside surface of said upper wall section, such that when said elongated side wall sections are adhered to said lower and upper wall sections, respectively, said lower and upper portions of said box are formed said tabs being spaced apart in such a way that a substantial, empty area is defined between said each two adjacent tabs, said empty area having a substantially rectangular configuration and extending along said longitudinal edges of each section, said tabs on the lower and upper portions of said box extending substantially below and above a level of the longitudinal edges, respectively, so that a plurality of ventilation passages is defined between said tabs and said lower and upper wall sections.

2. The box assembly of claim 1 wherein said lower and upper portions are made of cardboard.

3. The box assembly of claim 1 wherein said tabs are pre-glued.

4. The box assembly of claim 3 wherein said tabs are pre-glued with thermosetting glue.

5. The box assembly of claim 1 wherein said flat upper and lower wall sections are circular.

6. The box assembly of claim 1 wherein said flat upper and lower wall sections are elliptical.

7. The box assembly of claim 1 wherein said flat upper and lower wall sections are substantially rectangular.

8. The box assembly of claim 1 wherein the base of said tabs are scored.

9. A box assembly according to claim 1 wherein said tabs having at least two sides extending substantially perpendicularly form the longitudinal edges, and an area between two adjacent tabs is substantially empty.

10. A method for packaging objects into a box including a lower portion and an upper portion, one portion slidably fitting onto the other portion, comprising:

providing a flat lower wall section;

providing a flat upper wall section, having a different surface area from said lower wall section;

providing a pair of elongated side wall sections, the side wall sections including a plurality of spaced apart tabs extending from one longitudinal edge of each section;

folding said tabs at substantially right angles to said elongated side wall section;

securing the ends of said wall section together;

adhering said tabs of one side wall section to an inside perimeter surface of said lower wall section, forming said lower portion;

adhering said tabs of the other side wall section to an inside surface of said upper wall section, forming said upper portion;

placing said object within said lower portion; and securing said upper portion over said lower portion, thereby enclosing said object within said box, whereby said tabs being spaced apart in such a way that a substantial, empty area is defined between said each two adjacent tabs, said empty area having a substantially rectangular configuration and extending along said longitudinal edges of each section, said tabs on the lower and upper portions of said box in the bent condition extending substantially below and above a level of the longitudinal edges, respectively, so that a plurality of ventilation passages is defined between said tabs and said lower and upper wall sections.

* * * * *